US010347402B1

(12) United States Patent
Du et al.

(10) Patent No.: US 10,347,402 B1
(45) Date of Patent: Jul. 9, 2019

(54) THERMAL FUSE RESISTOR

(71) Applicant: XIAMEN SET ELECTRONICS CO., LTD, Xiamen (CN)

(72) Inventors: Shunyuan Du, Xiamen (CN); Lyubo Lin, Xiamen (CN); Yousheng Xu, Xiamen (CN); Changzhou Zhang, Xiamen (CN)

(73) Assignee: XIAMEN SET ELECTRONICS CO., LTD., Xiamen (CN)

( * ) Notice: Subject to any disclaimer, the term of this patent is extended or adjusted under 35 U.S.C. 154(b) by 0 days.

(21) Appl. No.: 15/986,864

(22) Filed: May 23, 2018

(51) Int. Cl.

| | |
|---|---|
| ***H01H 85/20*** | (2006.01) |
| ***H01H 85/055*** | (2006.01) |
| ***H01C 1/14*** | (2006.01) |
| ***H01C 1/01*** | (2006.01) |
| ***H01H 85/02*** | (2006.01) |

(52) U.S. Cl.
CPC ..... *H01C 1/14* (2013.01); *H01C 1/01* (2013.01); *H01H 85/0241* (2013.01); *H01H 85/055* (2013.01); *H01H 85/20* (2013.01)

(58) Field of Classification Search
CPC ..... H01C 1/14; H01C 1/01; H01H 85/0241; H01H 85/055; H01H 85/20
USPC ..... 337/159
See application file for complete search history.

(56) References Cited

U.S. PATENT DOCUMENTS

| | | | | |
|---|---|---|---|---|
| 2,973,418 | A * | 2/1961 | Whitman | H01H 85/0241 337/163 |
| 3,735,312 | A * | 5/1973 | Nagel | H01C 3/20 337/15 |
| 3,735,318 | A * | 5/1973 | Bucklin | H01H 85/046 337/160 |
| 3,836,883 | A * | 9/1974 | Takayasu | H01H 85/046 337/159 |
| 3,931,602 | A * | 1/1976 | Plasko | H01H 85/044 337/163 |
| 4,031,497 | A * | 6/1977 | Ozawa | H01H 85/046 337/297 |
| 4,527,143 | A * | 7/1985 | Thienel | H01H 85/32 337/242 |
| 5,418,516 | A * | 5/1995 | Oh | H01H 85/048 338/21 |
| 6,647,779 | B2 * | 11/2003 | Ishiguro | G01F 1/69 374/E7.021 |
| 7,529,072 | B2 * | 5/2009 | Nishikawa | H01H 37/761 361/103 |
| 7,920,044 | B2 * | 4/2011 | Scheiber | D06F 58/26 337/186 |

(Continued)

*Primary Examiner* — Anatoly Vortman
(74) *Attorney, Agent, or Firm* — Gokalp Bayramoglu

(57) ABSTRACT

A thermal fuse resistor including a ceramic substrate, a resistor body, a temperature sensing body, a first electrode cap, a second electrode cap, a first lead wire, a second lead wire, and a third lead wire. A first end of the ceramic substrate is provided with a first electrode cap, and a second end of the ceramic substrate is provided with a second electrode cap. The first electrode cap includes a main body, an inner end, and an outer end with an opening. The outer end includes an everted edge closely contacting the first end of the ceramic substrate. The main body and the inner end are arranged inside the ceramic substrate. The first lead wire extends outward from an outer end. One end of the third lead wire is electrically connected to the second electrode cap.

19 Claims, 5 Drawing Sheets

(56) References Cited

U.S. PATENT DOCUMENTS

| | | | | |
|---|---|---|---|---|
| 8,400,252 | B2 * | 3/2013 | Jung | H01H 85/0052 337/182 |
| 9,240,300 | B2 * | 1/2016 | Xu | H01C 1/14 |
| 9,530,545 | B2 * | 12/2016 | Xu | H01H 85/055 |
| 10,170,266 | B2 * | 1/2019 | Lee | H01C 17/04 |
| 2004/0100352 | A1 * | 5/2004 | Tanaka | H01H 37/761 337/159 |
| 2005/0248433 | A1 * | 11/2005 | Kim | H01C 7/13 338/24 |
| 2011/0188165 | A1 * | 8/2011 | El Filali | H01C 7/13 361/93.9 |
| 2012/0038450 | A1 * | 2/2012 | Jung | H01H 85/0052 337/184 |
| 2016/0042905 | A1 * | 2/2016 | Xu | H01H 37/765 337/148 |
| 2018/0254163 | A1 * | 9/2018 | Lee | H01C 17/04 |

* cited by examiner

THERMAL FUSE RESISTOR

TECHNICAL FIELD

The present invention relates to a circuit protection device, in particular to a thermal fuse resistor which can protect against over-current and over-temperature.

BACKGROUND

A switching mode power supply typically consists of a pulse width modulation (PWM) control integration circuit and a MOSFET. With the development and innovation of power electronic technology, switching mode power supply technology is also constantly improving. At present, switching mode power supplies are widely used in almost all electronic devices due to its small size, light weight, and high efficiency, and have become an indispensable power supply for the rapid development of the electronic information industry today.

In switching mode power supplies, wire-wound fuse resistor is usually used by people as overcurrent protection for switching mode power supply products. Although the wire-wound resistor is also capable of cutting off the over-current by fusing, since its resistance wire is made of high-melting-point alloy, only when the power is over ten or more times of the rated power of the resistor, the alloy wire of the wire-wound resistor would be overheated and therefore fused in a short time, under such circumstance, the fuse wire function against fault current of the wire-wound fuse resistor is reflected. However, in practical applications, when the load is in abnormal condition, the current flowing through the wire-wound fuse resistor is often below the fusing current, such that the fusing function of the wire-wound resistor does not work while the surface temperature of the wire-wound resistor reaches 300° C.~500° C. or even higher, which makes the devices such as chargers etc. unsafe, and raises a risk of fire. To solve this problem, the wire-wound resistor is externally connected to a thermal fuse in series and placed together with the thermal fuse inside a ceramic box. When the heat of the wire-wound resistor reaches the rated temperature of the thermal fuse, the thermal fuse gets cut-off, thereby cutting off the circuit. However, the method of externally connecting the thermal fuse in series beside the wire-wound resistor must occupy two areas on the PCB and requires four pads. Moreover, the heat transfer is not reliable enough, and the reliability of cutting-off according to temperature is poor.

In a currently used thermal fuse resistor, the thermal fuse is externally connected to the wire-wound resistor, and a lead wire of the thermal fuse is connected to a lead wire of the wire-wound resistor by spot-welding to form a series-connected structure. The thermal fuse resistor is relatively smaller in size and has a better over-current and over-temperature protection, but cannot realize the axial taping function and cannot meet the demand of automatic plug-in at the client end.

In another thermal fuse resistor existing in the current market, the thermal fuse is configured inside the wire-wound resistor, a lead wire of the thermal fuse is connected to an end cap of the wire-wound resistor, so that the thermal fuse and the wire-wound resistor form a series-connected structure, and the other lead wire of the thermal fuse and the other lead wire of the wire-wound resistor are led out in the same direction. This type of thermal fuse resistor has small size and good over-current and over-temperature protection function, but cannot realize the axial taping function and meet the demand of automatic plug-in at the client end.

SUMMARY

In order to solve the above-mentioned problem, the present invention provides an integrated device of thermal fuse and resistor which is novel, small in volume, structurally integrated, available for axial taping, and is suitable for automatic plug-in on the circuit board. With the thermal fuse and the resistor combined as a whole, the shape and size of the device is equal to that of the wire-wound resistor, the carbon film resistor, and the metal film resistor having the same power, so that the device has the advantages of small volume, anti-surge, excellent over-current & over-temperature protection function, and good insulation and voltage endurance performance. The integrated device of the present invention is also suitable for the automatic plug-in of circuit board and can be used for over-current and over-temperature protection of household appliances, communication equipment, power equipment, industrial control equipment, LED lightings, electric blankets, batteries and the like.

The present invention may also be used for locked-rotor fault protection for motors of electric tools, electric fans etc. When the motor is in locked-rotor condition, the speed with which the current causes the thermal fuse to be heated and cut-off is much faster than the speed of the temperature increase of the motor coil, thereby protecting the motor from damage due to overheating before the thermal fuse is cut-off. So, the present invention is an effective protection against the overheating of motor.

The objectives of the present invention are achieved through the following solutions.

A thermal fuse resistor includes a ceramic substrate, a resistor body, a temperature sensing body, a first electrode cap, a second electrode cap, a first lead wire, a second lead wire, a third lead wire, and an insulation coating arranged on a surface of the resistor for sealing and insulating the resistor. The resistor body may be alloy resistive wire carbon film, metal film, or any material that can be used as resistor is acceptable. The ceramic substrate includes a first end having an opening and a second end back in a distance from the first end. The first end is provided with a first electrode cap, and the second end is provided with a second electrode cap. The first electrode cap includes a main body, an inner end, and an outer end having an opening. The outer end includes an everted edge closely contacting the first end of the ceramic substrate, the main body and the inner end are arranged inside the ceramic substrate, and the inner end is close to the second end of the ceramic substrate. The resistor body is located at an outer side of the ceramic substrate. Two ends of the resistor body are electrically connected to the first electrode cap and the second electrode cap, respectively. The temperature sensing body is arranged in an inner cavity of the first electrode cap, and two ends of the temperature sensing body are respectively connected to the first lead wire and the second lead wire. The first lead wire extends outward from an outer end of the first electrode cap and is used as a first pin of the thermal fuse resistor. One end of the second lead wire is connected to the temperature sensing body, and the other end of the second lead wire is electrically connected to an inner end of the first electrode cap. One end of the third lead wire is electrically connected to the second electrode cap and is used as a second pin of the thermal fuse resistor.

The first electrode cap transfers the heat of the resistor body to the temperature sensing body. When the temperature rises to a cut-off temperature of the temperature sensing body, the temperature sensing body is fused. The effect of heat conduction is not only related to the heat conductivity of the conducting object but also related to the length and the cross-sectional area of the conducting object. By using the first electrode cap as the conducting object, the heat conduction rate can be improved because the cross-sectional area of the first electrode cap is greatly larger than that of the conducting line used as the conducting object, so, the fusing of the temperature sensing body is more responsive, and the heat generated by the resistor can be effectively and timely conducted to the temperature sensing body located inside, through the electrode cap. Therefore, the temperature sensing body is timely fused and the objective of protecting the circuit is achieved.

Further, the first lead wire, the temperature sensing body and the second lead wire are axially connected. The first lead wire and the third lead wire are centrally led out from both ends of the ceramic substrate. The first lead wire, the temperature sensing body, the second lead wire, and the third lead wire are in the same straight line. Two pins of the thermal fuse resistor of the present invention are in the same straight line, which is beneficial for the axial taping of the thermal fuse resistor and is convenient for an automatic plug-in of a printed circuit board.

Preferably, the first lead wire is made of a material with relatively poor thermal conductivity, for example tin-coated copper-clad steel wire, so as to improve the endurance capability of thermal fuse resistor in soldering such as wave soldering etc. Therefore, the temperature sensing body can avoid cut-off in the soldering process, and the performance in soldering is enhanced.

Further, the second lead wire is an extension of the temperature sensing body. The temperature sensing body is directly connected to the first electrode cap, so the heat of the resistor body is conducted to the temperature sensing body faster, and the temperature sensing body is more responsive to the temperature. Moreover, by doing so, a connection process of the second electrode is omitted, so the process is simple.

Further, the first electrode cap is of a tubular shape, having an opening at the inner end. The second lead wire is inserted into the opening at the inner end, so as to realize an electrical connection with the first electrode cap. The first electrode cap may be of a cylindrical shape or other tubular shape according to the practical situation. In the design of size, the opening at the inner end can be designed with an inner diameter equal to the diameter of the second lead wire for better connection.

Further, the first electrode cap is of a tubular shape with a constrictive port. The inner end of the first electrode cap is a tapered constrictive port, and the second lead wire is inserted into the tapered constrictive port. By doing so, the connection of the second lead wire and the inner end of the first electrode cap can be easily realized.

Further, the temperature sensing body is a low-melting-point metal wire, and fluxes are adhered around the temperature sensing body.

Further, the outer end of the first electrode cap is sealed by a first insulator. The first lead wire extends outward from the first insulator. The first insulator is used for sealing and insulating the outer end of the first electrode cap, so the fluxes fused at a high temperature are prevented from flowing out, an insulation between the first electrode cap and the first lead wire is realized, and an electrical clearance and a creepage distance are ensured. The first insulator may be made by the following materials: epoxy resin, unsaturated polyester, silicone resin, polyurethane, silicone rubber, alkyd or acrylic resin.

Further, a second insulator is partially filled between the first electrode cap and the ceramic substrate. The part near the end of the first electrode cap (i.e. the area between the connection point of the second lead wire, the first electrode cap and the bottom of the ceramic substrate) is not filled with the second insulator. The area filled with the second insulator improves the conduction of heat emitted by the resistor body, so the heat can be conducted to the temperature sensing body located inside in time. The area not filled with the second insulator ensures that when the flux and the gas located inside are expended by heat as a result of heat emission of the resistor body, the pressure can be released from the small hole of the first electrode cap due to the melting of the temperature sensing body. Therefore, a separation of the first insulator and the first electrode cap caused due to the occurrence of pressure generated by the thermal expansion of the flux and the gas can be avoided. The second insulator can be made of the following materials: epoxy resin, unsaturated polyester, silicone resin, polyurethane, silicone rubber, alkyd or acrylic resin. Here, the second insulator can be made of the same material as the first insulator sealing the outer end of the first electrode cap or may be separately selected according to different circumstances.

Further, the insulation coating is one or more item selected from organic materials such as epoxy resin, silicone resin, silicone rubber, etc. and inorganic materials.

Further, an inner cavity wall of the first electrode cap is attached with an insulation coating layer. The insulation coating layer can further ensure that there is a sufficient creepage distance and electrical clearance between the first lead wire and the first electrode cap after the temperature sensing body is cut-off. The insulation coating layer may be one or more item selected from acetal paint, polyurethane paint, polyesterimide paint, polyester paint, polyamideimide paint, polyimide paint, alkyd paint, epoxy paint, and organosilicon paint.

Further, the inner cavity of the first electrode cap is coaxially provided with an insulation sleeve. The insulation sleeve is arranged around the first lead wire, the temperature sensing body, and the second lead wire. The insulation sleeve can further ensure that there is a sufficient creepage distance and electrical clearance between the first lead wire and the first electrode cap after the temperature sensing body is cut-off.

Further, the insulation sleeve includes a first portion and a second portion. The first portion is located near the first end of the ceramic substrate and the second portion is located near the second end of the ceramic substrate. The inner diameter of the first portion is smaller than the inner diameter of the second portion. The first portion of the insulation sleeve is used to fix the first lead wire, so as to ensure that the first lead wire is centrally led out from the first end of the ceramic substrate.

Further, a protective bushing arranged outside the thermal fuse resistor is also included. The protective bushing can suppress the device explosion caused by severe overload and keep the fragments produced by explosion inside the protective bushing, even if the device explodes due to a severe overload. Therefore, the explosion noise is reduced and the anti-explosion performance is improved. Moreover, the protective bushing can improve the insulation and voltage endurance performance of the device. The protective bushing may be made of inorganic materials such ceramic tube, glass tube etc., organic materials such as silicon resin, alkyd resin, etc., or composite materials combined by inorganic materials and organic materials.

Further, the resistor body may be a resistance alloy wire, carbon film, metal film or metal oxide film.

Further, the second lead wire is hermetically connected to the inner end of the first electrode cap, closely.

The advantages of the present invention are as follows.

1. Two pins of the thermal fuse resistor are centrally and symmetrically led out from both ends of the resistor and the two pins are in the same straight line, which facilitates the axial taping of the thermal fuse resistor and the automatic plug-in of the printed circuit board.

2. With the first electrode cap, the effect of heat conduction is better, the fusing of temperature sensing body is more accurate and responsive, thereby better protecting the circuit.

3. With the insulation material, capable of thermal conducting, arranged between the first electrode cap and the ceramic substrate, the heat of the resistance wire can be transferred to the temperature sensing body located inside more effectively, and the fusing of the temperature sensing body is more accurate and responsive, thereby providing better protection of the circuit.

4. By using the extension of the temperature sensing body as the second lead wire, the thermal energy generated by the heat emission of the resistor body as a result of overload can be conducted to the temperature sensing body located inside faster, so that the temperature sensing body is fused in time to cut off the circuit quickly. Therefore, the protection of circuit by quick action can be realized.

5. Since the lead wires are all configured as straight-line type, the production process is simpler, and the production cost is lower.

6. The thermal fuse resistor may use temperature sensing bodies with different fusing temperatures, so the cut-off temperature of the product is optional, therefore, the product can better protect the circuit and has better market applicability.

BRIEF DESCRIPTION OF THE DRAWINGS

FIG. 2 (*b*) is a sectional view showing that the second lead wire is replaced by the extension of the temperature sensing body;

FIG. 2 (*c*) is a sectional view showing that a gap between the first electrode cap and the ceramic substrate is partially filled with a second insulator;

FIG. 2 (*d*) is a sectional view showing that the second lead wire is replaced by an extension of the temperature sensing body and the gap between the first electrode cap and the ceramic substrate is partially filled with the second insulator;

FIG. 3 (*b*) is a sectional view showing that the inner cavity of the first electrode cap is attached with an insulation coating layer on the basis of FIG. 2 (*d*) of embodiment 1;

FIG. 3 (*c*) is a sectional view showing that the inner cavity of the first electrode cap is provided with an insulation sleeve on the basis of FIG. 2 (*c*) of embodiment 1;

FIG. 3 (*d*) is a sectional view showing that the inner cavity of the first electrode cap is provided with an insulation sleeve on the basis of FIG. 2 (*d*) of embodiment 1;

FIG. 4 (*b*) is a sectional view showing that a stretchable and transformable protective bushing is provided based on FIG. 3 (*d*);

FIG. 4 (*c*) is a sectional view showing that a non-transformable hard protective bushing is provided based on FIG. 3 (*c*);

FIG. 4 (*d*) is a sectional view showing that a non-transformable hard protective bushing is provided based on FIG. 3 (*d*);

DETAILED DESCRIPTION OF THE EMBODIMENTS

Hereinafter, exemplary embodiments of the present invention will be described in detail with reference to the drawings. The following embodiments are merely used to describe the preferred schemes of the present invention and should not be regarded as limiting the present invention.

Embodiment 1

Figure 1:
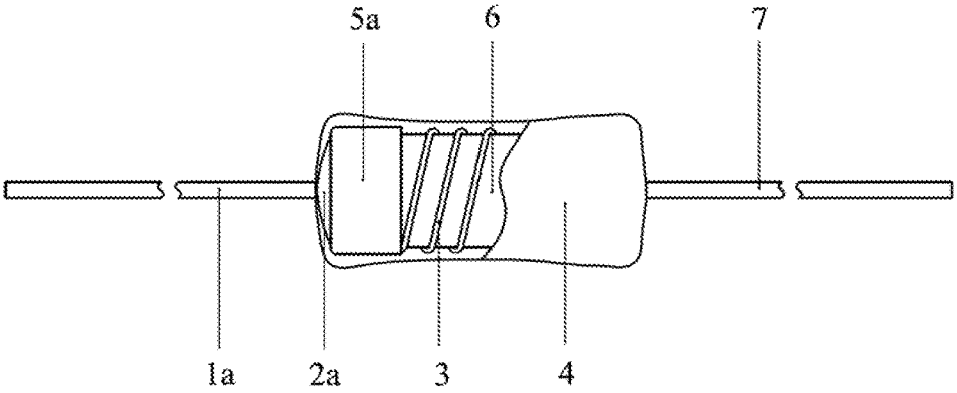
FIG. 1 shows a structural diagram of embodiment 1 of the present invention.
Figure 2A:
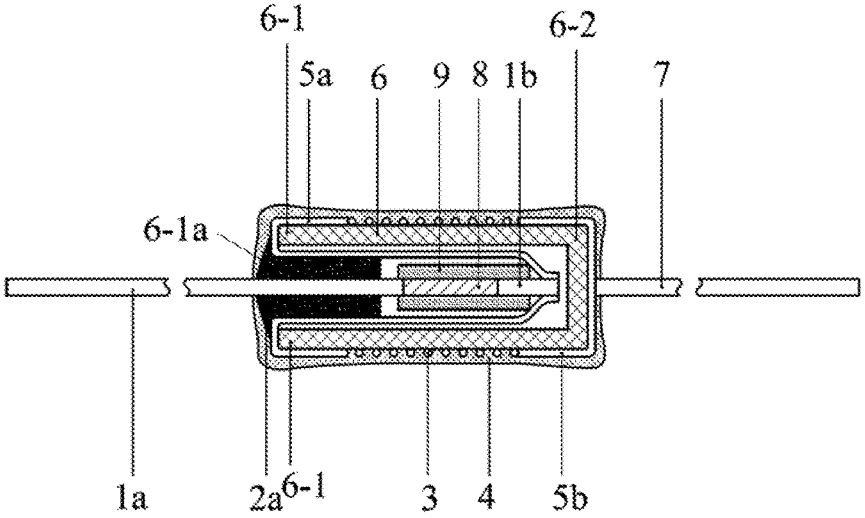
FIGS. 2 (*a*)-2 (*d*) are the sectional views of the device according to embodiment 1 of the present invention; wherein FIG. 2 (*a*) is a sectional view showing a mode of the temperature sensing body axially connecting to the first lead wire and the second lead wire.
Figure 2B:
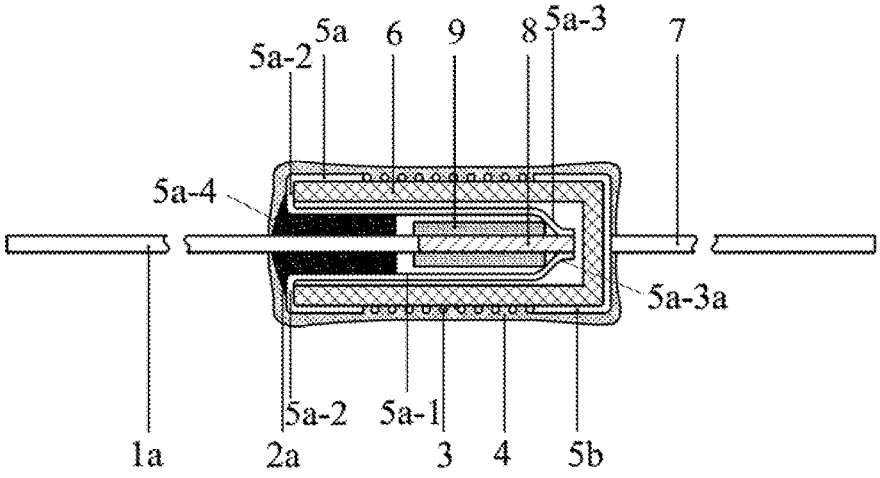
Figure 2C:
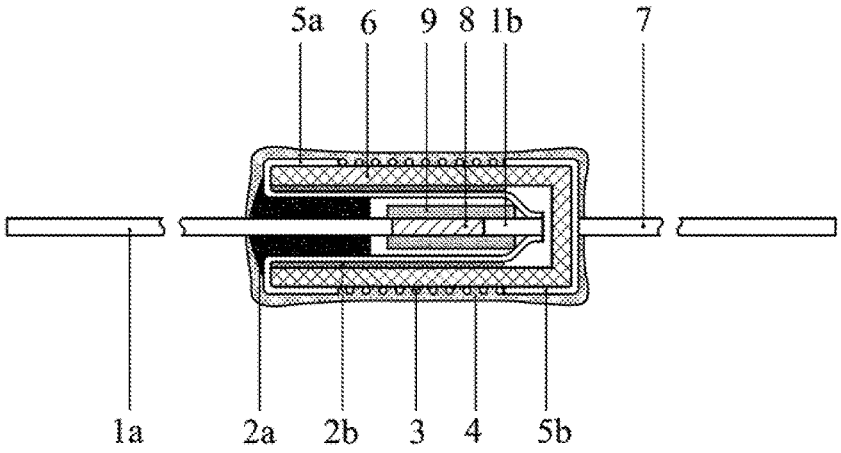
Figure 2D:
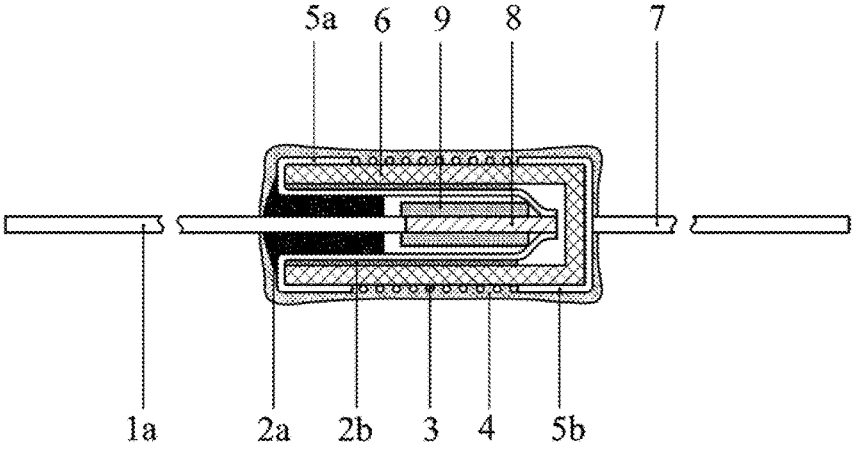
Figure 3A:
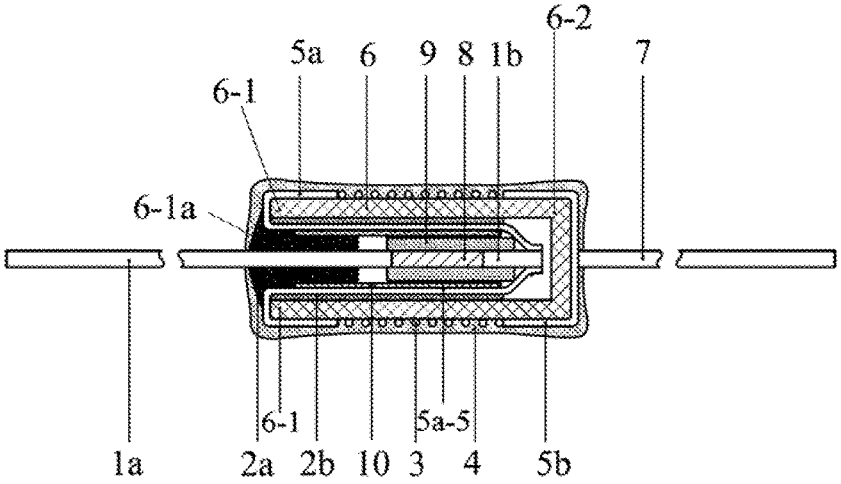
FIGS. 3 (*a*)-3 (*d*) are sectional views of the device according to embodiment 2 of the present invention; wherein FIG. 3 (*a*) is a sectional view showing that the inner cavity of the first electrode cap is attached with an insulation coating layer on the basis of FIG. 2 (*c*) of embodiment 1.
Figure 3B:
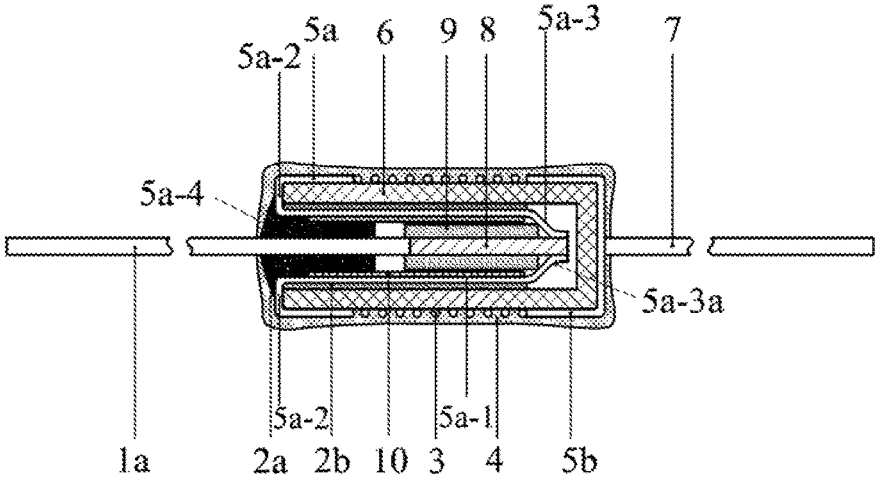
Figure 3C:
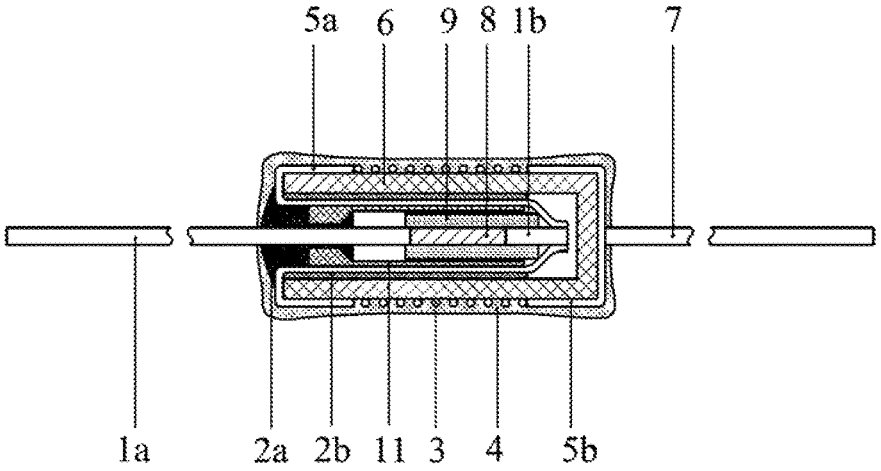
Figure 3D:
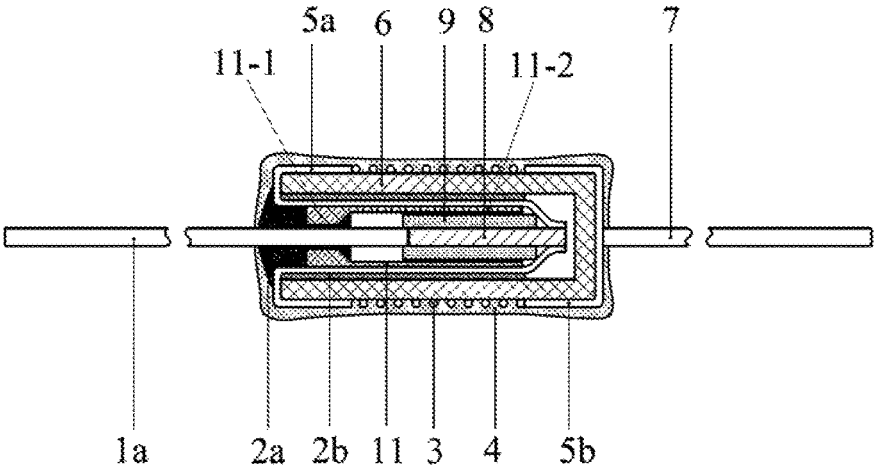
Figure 4A:
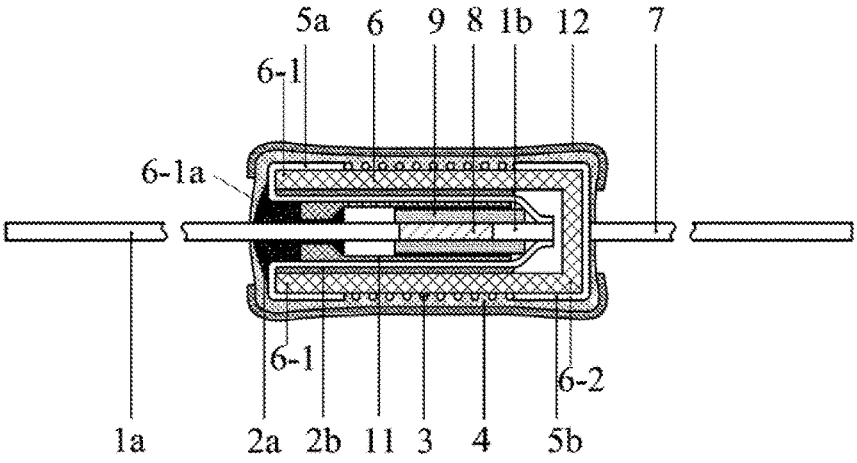
FIGS. 4 (*a*)-4 (*d*) are sectional views of the device according to embodiment 3 of the present invention; wherein FIG. 4 (*a*) is a sectional view showing that a stretchable and transformable protective bushing is provided based on FIG. 3 (*c*)
Figure 4B:
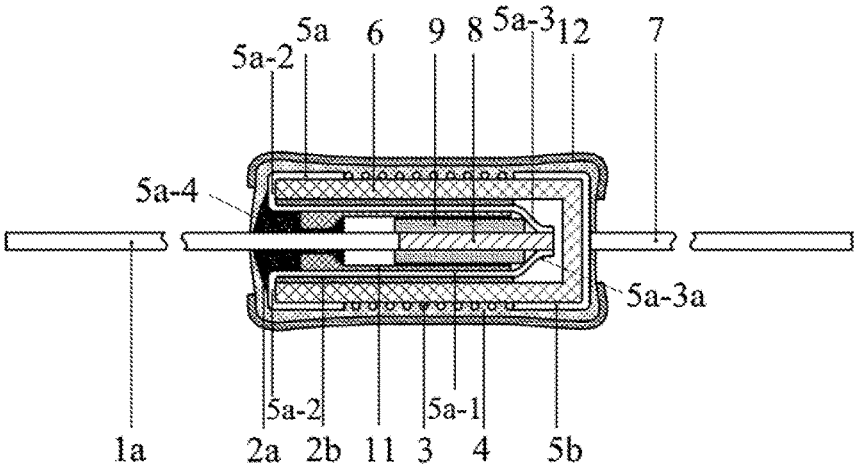
Figure 4C:
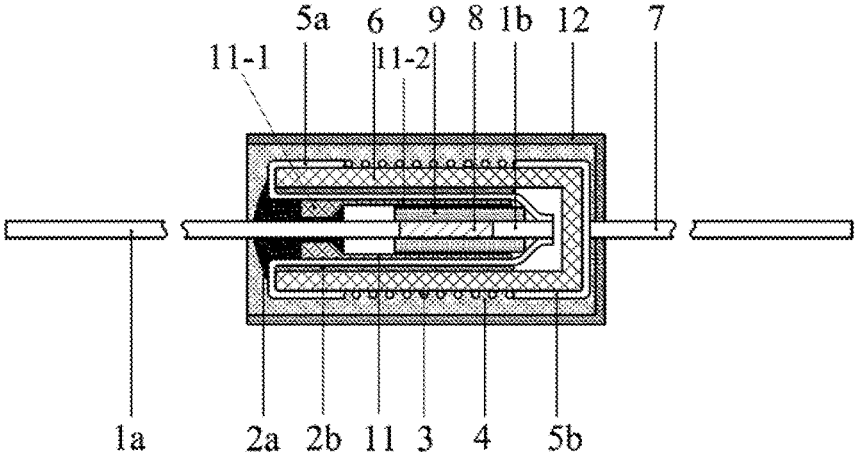
Figure 4D:
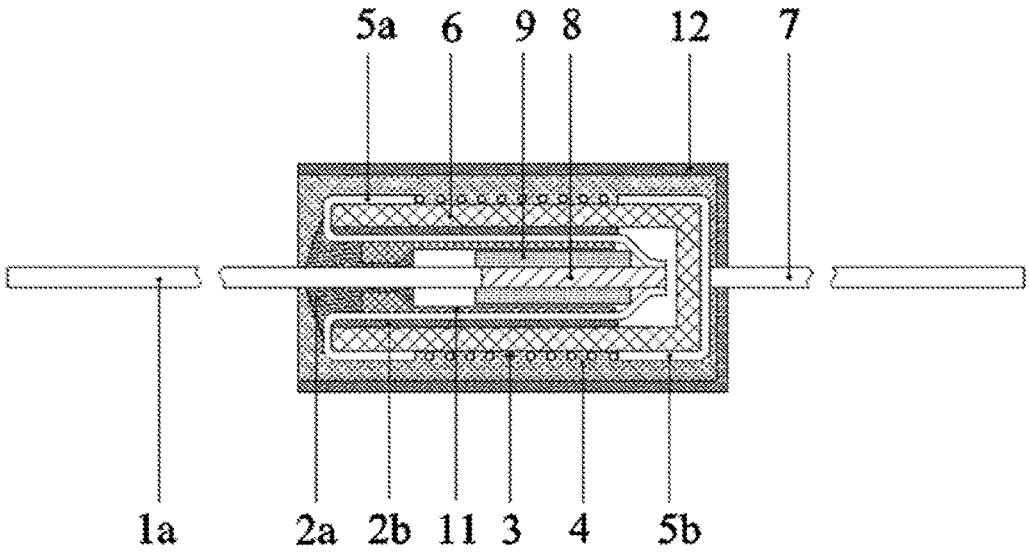

FIG. 1 and FIGS. 2(*a*)-2(*d*) show a structural view (partial sectional view) and a full sectional view of the device according to the first embodiment of the present invention.

As shown in the figures, the thermal fuse resistor in this embodiment includes a ceramic substrate 6 which has a cylindrical shape. The ceramic substrate 6 includes a first end 6-1 and a second end 6-2 at a distance from the first end 6-1. The first end 6-1 has a first opening 6-1*a* and the second end 6-2 is a closed end. The resistor body 3 is wound around the outer surface of the ceramic substrate 6. The first end 6-1 and the second end 6-2 of the ceramic substrate 6 are respectively provided with first electrode cap 5*a* and second electrode cap 5*b* tightly fitted with the ceramic substrate 6. Two ends of the resistor body 3 are respectively and electrically connected to the first electrode cap 5*a* and the second electrode cap 5*b*, and are fixed on the ceramic substrate 6 by the first electrode cap 5*a* and the second electrode cap 5*b*. The first electrode cap 5*a* includes a straight tubular main body 5*a*-1, an outer end 5*a*-2, and an inner end 5*a*-3. Both of the outer end 5*a*-2 and the inner end 5*a*-3 are second openings 5*a*-4. The outer end 5*a*-2 of the first electrode cap 5*a* has a large inner diameter and includes an everted edge. The everted edge is hermetically connected to the first end 6-1 of the ceramic substrate 6 tightly, and electrically connected to one end of the resistor body 3. The inner end 5*a*-3 of the first electrode cap 5*a* has a smaller inner diameter and is a tapered constrictive port 5*a*-3*a*. The main body 5*a*-1 and the tapered constrictive port 5*a*-3*a* of the first electrode cap 5*a* are both arranged in the inner cavity of the ceramic substrate 6. The temperature sensing body 8 is arranged in the inner cavity of the first electrode cap 5*a* and is a fusible metal wire. Both ends of the temperature sensing body 8 are respectively connected to the first lead wire 1*a* and the second lead wire 1*b*. Flux 9 is adhered around the temperature sensing body 8. One end of the first lead wire 1*a* back in a distance from the temperature sensing body 8, centrally passes through the first end of the first electrode cap 5*a* and extends outwards to be used as the first pin of the whole product. One end of the second lead wire 1*b* at a distance from the temperature sensing body 8 is hermetically connected to the tapered constrictive port 5*a*-3*a* of the first electrode cap 5*a* tightly, and is electrically connected to the first electrode cap 5*a* at the same position. One end of the third lead wire 7 is electrically connected to the top center of the second electrode cap 5*b*, and the other end extends outward to be used as the second pin of the whole product.

The outer end 5*a*-2 of the first electrode cap 5*a* is sealed by first insulator 2*a*. The first insulator 2*a* is made of epoxy resin. The outer surfaces of the resistor body 3, the ceramic substrate 6, the first electrode cap 5*a*, and the second electrode cap 5*b* are coated with insulation coating layer 4 which is one or combination of more selected from epoxy resin, silicone resin, silicone rubber, and inorganic materials. In the present embodiment, the insulation coating layer 4 is a silicone resin coating and forms an effective insulation layer with good insulation and voltage resistance performance.

It can be derived from FIG. 2 (*a*) that the temperature sensing body 8 may be extended and the extension thereof may be used as the second lead wire 1*b* as shown in FIG. 2 (*b*).

Based on FIG. 2 (*a*), a gap between the ceramic substrate 6 and the first electrode cap 5*a* is partially filled with second insulator 2*b* which is made of a thermally conductive silica gel. The effect of transferring the heat generated by the external resistor 3 to the inside when the circuit is turned on may be further improved. The structure is shown in FIG. 2 (*c*).

It can be derived from FIG. 2 (*c*) that the temperature sensing body 8 may be extended and the extension thereof may be used as the second lead wire 1*b* as shown in FIG. 2 (*d*).

Embodiment 2

As shown in the FIGS. 3(*a*)-3(*d*), the thermal fuse resistor in this embodiment include ceramic substrate 6 which has a cylindrical shape. The ceramic substrate 6 includes a first end 6-1 and a second end 6-2 at a distance from the first end. The first end 6-1 has a first opening 6-1*a* and the second end 6-2 is a closed end. Resistor body 3 is wound around the outer surface of the ceramic substrate 6. The first end 6-1 and the second end 6-2 of the ceramic substrate 6 are respectively provided with first electrode cap 5*a* and second electrode cap 5*b*, and the first electrode cap 5*a* and second electrode cap 5*b* are tightly fitted with the first end 6-1 and the second end 6-2 of the ceramic substrate 6. Two ends of the resistor body 3 are respectively electrically connected to the first electrode cap 5*a* and the second electrode cap 5*b*, and are fixed on the ceramic substrate 6 by the first electrode cap 5*a* and the second electrode cap 5*b*. The first electrode cap 5*a* includes a main body 5*a*-1 having straight tubular shape, an outer end 5*a*-2, and an inner end 5*a*-3. Both, the outer end 5*a*-2 and inner end 5*a*-3 are second openings 5*a*-4. The outer end 5*a*-2 of the first electrode cap 5*a* has a larger inner diameter and includes an everted edge. The everted edge is hermetically connected to the first end 6-1 of the ceramic substrate 6 tightly, and electrically connected to one end of the resistor body 3. The inner end 5*a*-3 of the first electrode cap 5*a* has a smaller inner diameter and is a tapered constrictive port 5*a*-3*a*. The main body 5*a*-1 and the tapered constrictive port 5*a*-3*a* of the first electrode cap 5*a* are both arranged in the inner cavity of the ceramic substrate 6. First insulation coating layer 10 is attached to the inner cavity wall 5*a*-5 of the first electrode cap 5*a*. The first insulation coating layer 10 may be made of acetal paint, polyurethane paint, polyesterimide paint, polyester paint, polyamideimide paint, polyimide paint, alkyd paint, epoxy paint, and organosilicon paint, etc. Preferably, the first insulation coating layer 10 is made of polyimide paint. The first insulation coating layer 10 can provide sufficient creepage distance and electrical clearance between the first lead wire 1*a* and the first electrode cap 5*a* after the opening of the temperature sensing body 8 because of overheating. The inner cavity of the first electrode cap 5*a* is provided with temperature sensing body 8 which is a fusible metal wire. Two ends of the temperature sensing body 8 are respectively connected to first lead wire 1*a* and second lead wire 1*b*. Flux 9 is adhered around the temperature sensing body 8. One end of the first lead wire 1*a* at a distance from the temperature sensing body 8 centrally passes through the first end of the first electrode cap 5*a* and extends outwards to be used as the first pin of the whole product. One end of the second lead wire 1*b* at a distance from the temperature sensing body 8 is hermetically connected to the tapered constrictive port 5*a*-3*a* of the first electrode cap 5*a* tightly, and is electrically connected to the first electrode cap 5*a* at this position. One end of the third lead wire 7 is electrically connected to the top center of the second electrode cap 5*b*, and the other end of the same extends outward to be used as the second pin of the whole product.

It can be derived from FIG. 3 (*a*) that the temperature sensing body 8 may be extended and the extension thereof may be used as the second lead wire 1*b* as shown in FIG. 3 (*b*).

The outer end 5*a*-2 of the first electrode cap 5*a* and the gap between the first electrode cap 5*a* and the ceramic substrate 6 are partially sealed by second insulator 2*b*. Here, the second insulator 2*b* is epoxy resin for improving the strength. The outer surfaces of the resistor body 3, the ceramic substrate 6, the first electrode cap 5*a*, and the second electrode cap 5*b* are coated with insulation coating layer 4, which is one or combination of more selected from epoxy resin, silicone resin, silicone rubber, and inorganic materials. In the present embodiment, the insulation coating layer 4 is a silicone resin coating which forms an effective insulation layer, thus, the present invention has a good insulation and voltage endurance performance.

On the basis of FIG. 3(*a*) and FIG. 3(*b*), the first insulation coating layer 10 may be replaced with insulation sleeve 11, namely, the insulation sleeve 11 is arranged in the inner cavity of the first electrode cap 5*a* to ensure that the first lead wire 1*a* and the first electrode cap 5*a* have sufficient electrical clearance and creepage distance after the temperature sensing body 8 is fused and cut-off. The insulation sleeve may be made of inorganic materials such as glass, ceramics, plastics, rubbers etc. or organic materials or composite materials. In this embodiment, the insulation sleeve 11 is a ceramic sleeve. The insulation sleeve 11 in this embodiment includes a first portion 11-1 located near the first electrode cap 5*a* and a second portion 11-2 located near the second electrode cap 5*b*. The inner diameter of the first portion 11-1 is smaller than that of the second portion 11-2 and slightly larger than the diameter of the first lead wire 1*a*, so as to ensure that the first lead wire 1*a* is centrally led out from the first portion 11-1 of the insulating sleeve 11 and the outer end 5*a*-2 of the first electrode cap 5*a*. The first portion 11-1 and the second portion 11-2 of the insulation sleeve 11 are tapered transition which facilitates the first lead wire 1*a* to pass through the insulation sleeve 11 smoothly during product assembly process. By doing so, the first lead wire 1*a* and the third lead wire 7 are symmetrically led out from the center of the cross section of the ceramic substrate 6 to form two pins of the thermal fuse resistor, so that the two pins of the thermal fuse resistor of the present invention are in the same straight line, which facilitates the axial taping of the thermal fuse resistor and the automatic plug-in of the printed circuit board. On the basis of FIG. 3(*a*), the first insulation coating layer 10 is replaced by the insulation sleeve 11 to form the structure of FIG. 3(*c*). On the basis of FIG. 3(*b*), the first insulation coating layer 10 is replaced by the insulation sleeve 11 to form the structure of FIG. 3(*d*).

Embodiment 3

As shown in FIGS. 4(*a*)-4(*d*), the thermal fuse resistor in this embodiment includes ceramic substrate 6 having a cylindrical shape. The ceramic substrate 6 includes a first end 6-1 and a second end 6-2 at a distance from the first end. The first end 6-1 has a first opening 6-1*a* and the second end 6-2 is a closed end. The resistor body 3 is wound around the outer surface of the ceramic substrate 6. The first end 6-1 and the second end 6-2 of the ceramic substrate 6 are respectively provided with first electrode cap 5*a* and second electrode cap 5*b*, and the first electrode cap 5*a* and second electrode cap 5*b* are tightly fitted with the first end 6-1 and the second end 6-2 of the ceramic substrate 6. Two ends of the resistor body 3 are respectively electrically connected to the first electrode cap 5*a* and the second electrode cap 5*b*, and are fixed on the ceramic substrate 6 by the first electrode cap 5*a* and the second electrode cap 5*b*. The first electrode cap 5*a* includes a main body 5*a*-1 having a straight tubular shape, an outer end 5*a*-2, and an inner end 5*a*-3. Both of the outer end 5*a*-2 and the inner end 5*a*-3 are second openings 5*a*-4. The outer end 5*a*-2 of the first electrode cap 5*a* has a larger inner diameter and includes an everted edge. The everted edge is hermetically connected to the first end 6-1 of the ceramic substrate 6 tightly, and electrically connected to one end of the resistor body 3. The inner end 5*a*-3 of the first electrode cap 5*a* has a smaller inner diameter and is a tapered constrictive port 5*a*-3*a*. The main body 5*a*-1 and the tapered constrictive port 5*a*-3*a* of the first electrode cap 5*a* are both arranged in the inner cavity of the ceramic substrate 6. The inner cavity of the first electrode cap 5*a* is provided with insulation sleeve 11 having openings at both ends. The inner cavity of the first electrode cap 5*a* is further provided with temperature sensing body 8 which is a fusible metal wire. Both ends of the temperature sensing body 8 are respectively electrically connected to the first lead wire 1*a* and the second lead wire 1*b*. Flux 9 is adhered around the temperature sensing body 8. One end of the first lead wire 1*a* back in a distance from the temperature sensing body 8 centrally passes through insulation sleeve 11 and the first end of the first electrode cap 5*a* and extends outwards to be used as the first pin of the whole product. The insulation sleeve 11 ensures that the first lead wire 1*a* and the first electrode cap 5*a* have sufficient electrical clearance and the creepage distance after the temperature sensing body 8 is fused and cut-off. The insulation sleeve may be made of inorganic materials such as glass, ceramics, plastics, rubbers etc. or organic materials or a composite material. In this embodiment, the insulation sleeve 11 is a ceramic sleeve. The insulation sleeve 11 in this embodiment includes a first portion 11-1 located near the first electrode cap 5*a* and the second portion 11-2 located near the second electrode cap 5*b*. The inner diameter of the first portion 11-1 is smaller than that of the second portion 11-2 and slightly larger than the diameter of the first lead wire 1*a*, so as to ensure that the first lead wire 1*a* is centrally led out from the first portion 11-1 of the insulation sleeve 11 and the outer end 5*a*-2 of the first electrode cap 5*a*. One end of the second lead wire 1*b* at a distance from the temperature sensing body 8 is hermetically connected to the tapered constrictive port 5*a*-3*a* of the first electrode cap 5*a* tightly, and is electrically connected to the first electrode cap 5*a* at this position. One end of the third lead wire 7 is electrically connected to the top center of the second electrode cap 5*b*, and the other end of the same extends outward to be used as the second pin of the whole product.

The outer end 5*a*-2 of the first electrode cap 5*a* and the gap between the first electrode cap 5*a* and the ceramic substrate 6 are partially sealed by second insulator 2*b*. Here, the second insulator 2*b* is epoxy resin for improving the strength. The outer surfaces of the resistor body 3, the ceramic substrate 6, the first electrode cap 5*a*, and the second electrode cap 5*b* are coated with insulation coating layer 4 which is one or combination of more selected from epoxy resin, silicone resin, silicone rubber, and inorganic materials. In the present embodiment, the insulation coating layer 4 is silicone resin coating which forms an effective insulation layer. Therefore, the present invention has good insulation and voltage resistance performance.

It can be derived from FIG. 4 (*a*) that the temperature sensing body 8 may be extended and the extension thereof may be used as the second lead wire 1*b* as shown in FIG. 4 (*b*).

It can also be derived from FIG. 4 (*c*) that the temperature sensing body 8 may be extended and the extension thereof may be used as the second lead wire 1*b* as shown in FIG. 4 (*d*).

In addition, protective bushing 12 is provided outside the insulation coating layer 4. As shown in FIGS. 4(*a*) and 4 (*b*), the protective bushing may be a soft protective bushing which has openings at two ends and is stretchable and transformable, or as shown in FIG. 4(*c*) and FIG. 4(*d*), the protective bushing may be a hard protective bushing which is non-transformable. The soft protective bushing may be one selected from heat shrinkable tubing, silicone bushing, rubber bushing, fiberglass bushing, fiberglass bushing with silica gel layer etc. Preferably, soft protective bushing is heat shrinkable tubing. The non-deformable hard protective bushing may be made of materials having similar functions such as plastic, glass, ceramics etc. Preferably, the non-deformable hard protective bushing is made of ceramic materials. FIG. 4(*a*) shows that a stretchable and deformable protective bushing with openings at two ends is arranged outside the insulation coating layer based on FIG. 3(*c*) of embodiment 2. The first lead wire 1*a* and the third lead wire 7 are respectively centrally led out from two ends of the opening of the protective bushing to be used as two pins of the whole product. FIG. 4(*b*) shows that a stretchable and deformable protective bushing with openings at two ends is arranged outside the insulation coating layer based on FIG. 3(*d*) of embodiment 2. The first lead wire 1*a* and the third lead wire 7 are respectively centrally led out from two ends of the opening of the protective sleeve to be used as two pins of the whole product. FIG. 4(*c*) shows that a non-transformable hard protective bushing with openings at two ends is arranged outside the insulation coating layer based on FIG. 3(*c*) of embodiment 2. The first lead wire 1*a* and the third lead wire 7 are respectively centrally led out from two ends of the opening of the protective sleeve to be used as two pins of the whole product. FIG. 4(*d*) shows that a non-transformable hard protective bushing with openings at two ends is arranged outside the insulation coating layer based on FIG. 3(*d*) of embodiment 2. The first lead wire and the third lead wire are respectively centrally led out from two ends of the opening of the protective sleeve to be used as two pins of the whole product. By arranging the protective bushing, the explosion of device caused by severe overload can be suppressed, and fragments generated by explosion can be kept inside the protective bushing even if the device is exploded due to a severe overload, thereby reducing the explosion noise, and improving the anti-explosion performance. Also, the protective sleeve can improve the insulation and pressure performance of the device.

In summary, the device can be used for over-temperature and over-current protection of the circuit. When the ambient temperature reaches the melting point of the temperature sensing body inside the device, the temperature sensing body fuses, retracts towards the lead wires under the action of the flux, so that the temperature sensing body is cut-off and the circuit is protected. When a small fault current occurs in the circuit, the resistance wire in the device heats up, and the heat is effectively transferred to the temperature sensing body located inside. When the melting point of the temperature sensing body is reached, the temperature sensing body retracts towards two ends of the lead wires under the action of the flux, so that the temperature sensing body is cut-off, and the circuit is protected. When a large fault current occurs in the circuit, the resistor body in the device will heat up sharply to the melting point thereof so that the resistor body is cut-off, and the circuit is effectively protected.

Comparing the resistor (the resistance value of the resistor body is 10Ω, and the melting-point of the temperature sensing body is 218° C.) shown in FIG. 4 (*a*) of this embodiment with a commonly used wire-wound resistor having the same volume, resistor body, and resistance value, the comparison results of the surface temperature and the fusing-cut-off time under different test currents are shown in table 1 below. The surface temperature of the device before fusing and cut-off in this embodiment does not exceed 221° C., so the device used as an over-temperature over-current protection element of the circuit can ensure that there is no hidden danger of overheat. While using the commonly used wire-wound resistor, when a small fault current occurs in the circuit, the surface temperature can reach hundreds of degrees Celsius, which may cause the shells of chargers, LED lights etc. fusing and even start fire. In addition, low-melting-point metals with different fusing points may be selected as the temperature sensing body, thereby forming different levels of temperature protection and having wider selectivity.

TABLE 1

| Test | Resistor of embodiment 3 | | Common wire-wound resistor | |
|---|---|---|---|---|
| current (A) | Temperature (° C.) | Cut-off time (s) | Temperature (° C.) | Cut-off time (s) |
| 0 | 27.5° C. | No cut-off | 27.5° C. | No cut-off |
| 0.1 | 36.2° C. | No cut-off | 36.5° C. | No cut-off |
| 0.15 | 50.8° C. | No cut-off | 51.1° C. | No cut-off |

TABLE 1-continued

| Test | Resistor of embodiment 3 | | Common wire-wound resistor | |
|---|---|---|---|---|
| current (A) | Temperature (° C.) | Cut-off time (s) | Temperature (° C.) | Cut-off time (s) |
| 0.2 | 72.3° C. | No cut-off | 73.0° C. | No cut-off |
| 0.25 | 90.5° C. | No cut-off | 91.3° C. | No cut-off |
| 0.30 | 128.0° C. | No cut-off | 129.5° C. | No cut-off |
| 0.35 | 171.5° C. | No cut-off | 172.3° C. | No cut-off |
| 0.40 | 214.1° C. | No cut-off | 215.5° C. | No cut-off |
| 0.45 | 219.3° C. | 135 s | 245° C. | No cut-off |
| 0.50 | — | — | 279° C. | No cut-off |
| 0.60 | — | — | 388° C. | No cut-off |
| 0.70 | — | — | 467° C. | No cut-off |
| 0.80 | — | — | 582° C. | No cut-off |
| 0.90 | — | — | 729° C. | No cut-off |
| 1.00 | — | — | 905° C. | 128 s |

In table 1, the temperature of the device of embodiment 3 is the temperature at the middle position of the outer surface of the protective bushing, and the temperature of the common wire-wound resistor is the temperature at the middle position of outer surface of the main body.

Figure 5:
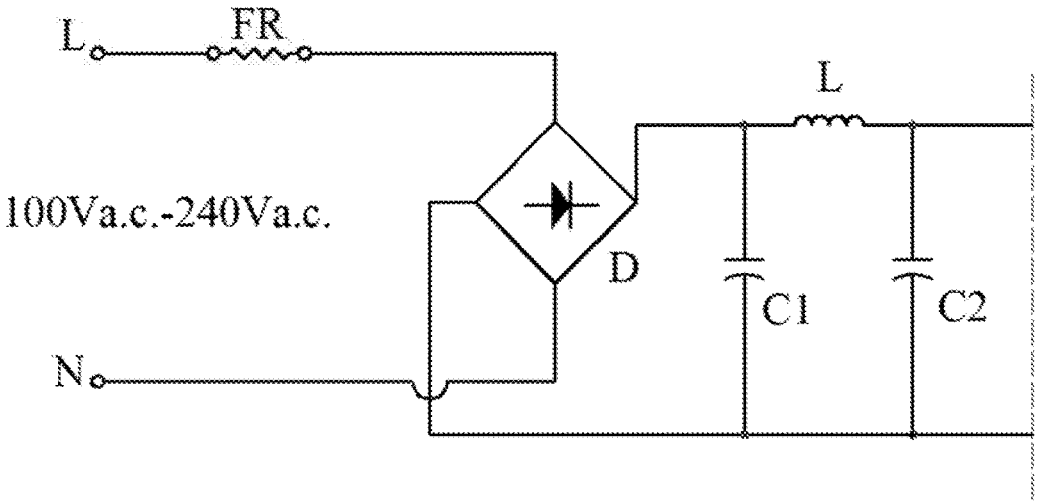
FIG. 5 is a circuit diagram showing that the resistor is used as an over-current protection element of a switching mode power supply.

FIG. 5 is a circuit diagram showing that the resistor (hereinafter referred to as FR) is used as an over-current protection element of the charger used as switching mode power supply. In the process of charging, elements such as rectifier bridge, filtering capacitor or metal oxide semiconductor (MOS transistor) etc. may be broken down and shorted out, at this time, the resistor will withstand a short circuit voltage ranged 100V a.c.-240V a.c. If the resistor is the existing coating-fusing resistor, such as wire-wound resistor, the moment when the resistor is cut-off, is followed with a high electric arc which makes the fragile coating splashing around with a loud blasting sound, which would frighten people around the charger. However, if the resistor is the device with protective bushing in the embodiment, the electric arc occurring at the moment when the resistor is cut-off can be suppressed, the fragile coating is limited inside the protective bushing without obvious blasting sound, thereby greatly improving the safety of using the charger.

The existing coating resistor and the resistor with protective bushing shown in FIG. 4 (*a*) of embodiment 3 were tested with short circuit under the same short circuit voltage, and the test results are shown in table 2.

TABLE 2

Comparison of short-circuit anti-explosion performance test results

| Short-circuit voltage (V a.c.) | Existing coating resistor | Resistor of embodiment 3 |
|---|---|---|
| 220 | Large sparks and loud blasting sound | No spark and blasting sound |
| 240 | Large sparks and loud blasting sound | No spark and blasting sound |

The foregoing merely shows the preferred embodiments of the present invention, rather than limiting the present invention. Although the present invention has been described in detail with reference to the embodiments, those skilled in the art can still modify the technical solutions described in the above-mentioned embodiments or substitute some of the technical features to similar objects. Any modification, substitution, improvement etc. without departing from the spirit and principles of the present invention, however, shall be considered as falling within the scope of the present invention.

What is claimed is:

1. A thermal fuse resistor, comprising:
a ceramic substrate;
a resistor body;
a temperature sensing body;
a first electrode cap;
a second electrode cap;
at least two lead wires; and
an insulation coating arranged on a surface of the resistor body, wherein
the ceramic substrate comprises a first end having a first opening and a second end;
the first electrode cap comprises a main body, an inner end, and an outer end having a second opening;
the first electrode cap and the second electrode cap are respectively arranged at the first end and the second end of the ceramic substrate;
two ends of the resistor body are respectively and electrically connected to the first electrode cap and the second electrode cap;
the temperature sensing body is arranged in the first electrode cap; and
the temperature sensing body is connected to the lead wire.

2. The thermal fuse resistor of claim 1 wherein,
the outer end comprises an everted edge;
the everted edge contacts the ceramic substrate;
the inner end located close to the second end of the ceramic substrate; and
the main body and the inner end are arranged inside the ceramic substrate.

3. The thermal fuse resistor according to claim 1, wherein
the at least two lead wires and the temperature sensing body are axially connected and in a same straight line; and
the at least two lead wires are centrally led out from the ceramic substrate, respectively.

4. The thermal fuse resistor according to claim 1, wherein
the first electrode cap is of a tubular shape.

5. The thermal fuse resistor according to claim 3, wherein
the inner end of the first electrode cap is a tapered constrictive port; and
one of the at least two lead wires is inserted into the tapered constrictive port.

6. The thermal fuse resistor according to claim 3, wherein
one of the at least two lead wires is hermetically connected to the inner end of the first electrode cap, closely.

7. The thermal fuse resistor according to claim 1, wherein
the temperature sensing body is a low-melting-point metal wire; and
a flux is adhered around the temperature sensing body.

8. The thermal fuse resistor according to claim 3, wherein
the outer end of the first electrode cap is sealed by a first insulator; and
one of the at least two lead wires extends outward from the first insulator.

9. The thermal fuse resistor according to claim 8, wherein
a second insulator is partially filled between the first electrode cap and the ceramic substrate.

10. The thermal fuse resistor according to claim 1, wherein
the insulation coating is one or more selected from the group consisting of epoxy resin, silicone resin, silicone rubber, and inorganic material.

11. The thermal fuse resistor according to claim 1, wherein
an inner cavity wall of the first electrode cap is attached with a first insulation coating layer; and
the first insulation coating layer is one or more selected from the group consisting of acetal paint, polyurethane paint, polyester paint, polyamideimide paint, polyesterimide paint, polyimide paint, alkyd paint, epoxy paint, and organosilicon paint.

12. The thermal fuse resistor according to claim 1, wherein
an inner cavity of the first electrode cap is coaxially provided with an insulation sleeve; and
the insulation sleeve is arranged around one or two of the at least two lead wires and the temperature sensing body.

13. The thermal fuse resistor according to claim 12, wherein
the insulation sleeve comprises a first portion and a second portion;
the first portion is located near the first end of the ceramic substrate;
the second portion is located near the second end of the ceramic substrate; and
an inner diameter of the first portion is smaller than an inner diameter of the second portion.

14. The thermal fuse resistor according to claim 1 further comprising
a protective bushing arranged outside the thermal fuse resistor.

15. The thermal fuse resistor according to claim 1, wherein
the resistor body is selected from the group consisting of resistance alloy wire, carbon film, metal film and metal oxide film.

16. The thermal fuse resistor according to claim 1, wherein
three lead wires are provided;
a first lead wire is led out from the outer end of the first electrode cap;
a first end of a second lead wire is connected to the temperature sensing body;
a second end of the second lead wire is hermetically connected to the inner end of the first electrode cap;
one end of a third lead wire is connected to the second electrode cap;
the first lead wire and the third lead wire are centrally led out from two sides of ceramic substrate; and
the first lead wire, the temperature sensing body, the second lead wire, and the third lead wire are located in the same straight line.

17. The thermal fuse resistor according to claim 16, wherein
the second lead wire is an extension of the temperature sensing body.

18. The thermal fuse resistor according to claim 14, wherein
the protective bushing is selected from the group consisting of shrinkable tubing, silicone bushing, rubber bushing, fiberglass bushing, and fiberglass bushing with silica gel layer.

19. The thermal fuse resistor according to claim 14, wherein
the protective bushing is selected from the group consisting of plastic, glass, and ceramics.

* * * * *